United States Patent [19]

Bauer

[11] Patent Number: 4,966,612

[45] Date of Patent: Oct. 30, 1990

[54] PROCESS FOR THE SEPARATION OF HYDROCARBONS

[75] Inventor: Heinz Bauer, München, Fed. Rep. of Germany

[73] Assignee: Linde Aktiengesellschaft, Wiesbaden, Fed. Rep. of Germany

[21] Appl. No.: 343,657

[22] Filed: Apr. 27, 1989

[30] Foreign Application Priority Data

Apr. 28, 1988 [DE] Fed. Rep. of Germany ..... 3814294

[51] Int. Cl.[5] ..... F25J 3/02

[52] U.S. Cl. ..... 62/24; 62/28

[58] Field of Search ..... 62/11, 23, 24, 27, 28, 62/32, 36

[56] References Cited

U.S. PATENT DOCUMENTS

| | | | |
|---|---|---|---|
| 4,486,209 | 12/1984 | Fabbri et al. | 62/28 |
| 4,596,588 | 6/1986 | Cook | 62/28 |
| 4,597,788 | 7/1986 | Apffel | 62/28 |
| 4,676,812 | 6/1987 | Kummann | 62/28 |
| 4,707,171 | 11/1987 | Bauer | 62/30 |
| 4,711,651 | 12/1987 | Sharma et al. | 62/24 |
| 4,718,927 | 1/1988 | Bauer et al. | 62/24 |

*Primary Examiner*—Ronald C. Capossela

*Attorney, Agent, or Firm*—Millen, White & Zelano

[57] ABSTRACT

In a process for the separation of hydrocarbons from a hydrocarbon mixture which optionally contains components boiling lower than methane, the crude gas stream is partially condensed and separated into a gaseous fraction and a liquid fraction. The liquid fraction is introduced into a rectification column wherein further separation is performed. The residual gas obtained at the head of the rectification column is partially condensed and introduced into a scrubbing column wherein the condensed portion of the residual gas is used as a scrubbing medium to scrub out low-boiling components from the separated, gaseous fraction. For covering the refrigeration requirement of this process, a portion of the residual gas from the rectification column, prior to being fed into the scrubbing column, is branched off and expanded for production of refrigeration. After heat exchange with process streams to be cooled, this portion of the residual gas stream is readmixed to the residual gas stream of the rectification column.

23 Claims, 2 Drawing Sheets

PROCESS FOR THE SEPARATION OF HYDROCARBONS

BACKGROUND OF THE INVENTION

The invention relates to a process for the separation of hydrocarbons from a gaseous feedstream containing light and heavy hydrocarbons and optionally containing components boiling lower than methane. The gaseous stream is introduced to the process under elevated pressure, cooled, partially condensed, and separated into a liquid and a gaseous fraction. The liquid fraction is fractionated by rectification into a product stream containing essentially higher-boiling components and a residual gas stream containing predominantly lower-boiling components. The gaseous fraction separated after the partial condensation is introduced into a scrubbing column wherein higher-boiling hydrocarbons are scrubbed out of the gaseous fraction using residual gas obtained during the rectification as the scrubbing medium, after the partial condensation of this residual gas. The liquid fraction obtained in the bottom of the scrubbing column is fed to rectification.

Such processes serve, above all, for the removal of ethane and propane from gaseous hydrocarbon mixtures, such as natural gas or refinery waste gases. Also, these processes are suitable for the separation of analogous, unsaturated hydrocarbons, such as ethylene and propylene. Refinery waste gases contain hydrocarbons of this type, and consequently their processing has become of interest due to rising market prices for $C_3/C_4$ hydrocarbon mixtures.

U.S. Pat. No. 4,707,171 discloses a process of the kind discussed above, wherein $C_{2+}$ or $C_{3+}$ hydrocarbons are separated from a gaseous mixture. A crude gas stream is partially condensed by countercurrent heat exchange with process streams which are to be heated. The partially condensed crude gas stream is separated in a separator into a liquid and a gaseous fraction. The liquid fraction consisting essentially of higher-boiling hydrocarbon components, $C_{2+}$or $C_{3+}$, is fed to a rectification column wherein lower-boiling components are removed therefrom. During this rectification step, a residual gas stream is obtained at the head of the rectification column. The residual gas stream, after its partial condensation, is introduced into a scrubbing column wherein higher-boiling components are scrubbed out of the gaseous fraction discharged from the separator. The bottom fraction thus obtained in the scrubbing column is likewise introduced into the rectification column.

The scrubbing step serves to increase the yield of the process since this step makes it possible to remove from the gaseous fraction of the separator, as well as from the residual gas of the rectifying column, $C_{2+}$ or $C_{3+}$ components which otherwise are unobtainable.

The above-described method has the disadvantage that the required process temperatures must be provided by means of a refrigeration facility, optionally a refrigeration cascade. For this purpose, a refrigeration-producing expansion of at least part of a residual gas stream from the scrubbing step is performed.

If it is intended to subject the residual gas stream(s) obtained to further processing, high pressures must be maintained. In such a case, refrigeration is produced by circulating refrigerant media in closed cycles. However, a disadvantage of this version of the process is that it is relatively expensive.

SUMMARY OF THE INVENTION

An object of the invention is to provide a process of the type discussed hereinabove wherein expensive production of refrigeration is avoided while simultaneously retaining high pressures of the residual gas streams.

Upon further study of the specification and appended claims, further objects and advantages of this invention will become apparent to those skilled in the art.

These objects are attained according to this invention by separating the residual gas obtained during the rectification, after the partial condensation thereof and prior to its introduction into the scrubbing column, into a residual gaseous fraction and a residual liquid fraction. At least a portion of the residual liquid fraction is expanded resulting in the production of refrigeration. This portion of the residual liquid fraction is then heated by heat exchange with residual gas from the rectification column, the latter undergoing partial condensation. The resultant heated portion of the residual liquid fraction is then readmixed with the residual gas stream from rectification while the remaining portion, if any, of the residual liquid fraction is fed into the scrubbing column.

By branching off a portion of the condensed residual gas stream, employing it as a refrigerating medium, and then readmixing it with the residual gas stream from rectification, an expensive refrigeration cascade can be avoided and high residual gas pressures can be maintained.

The readmixture of the portion of the liquid fraction of the residual gas stream, utilized as the refrigerating medium, with the gaseous head product of the rectification column, i.e., the residual gas stream from rectification, results in the total amount of fluid circulated being greater than the actual amount of gaseous head product from rectification. In this manner, the refrigeration produced from the branched-off portion of the condensed residual gas stream can be utilized for cooling additional process streams.

Generally, the molar ratio of the branched-off residual liquid fraction to the residual gas stream obtained from rectification before the point of admixture is about 1:5 to 5:1, preferably 1:2 to 2:1.

In order to maintain the pressures of the individual residual gas streams at a high level, for example for subsequent separating steps performed on these streams, the scrubbing column as well as the rectification column are operated under superatmospheric pressure.

The operating pressure range of the scrubbing column is generally about 10 to 40 bar, preferably 20 to 30 bar. In the rectification column, the operating pressure is generally about 8 to 35 bar, preferably 18 to 28 bar.

In one embodiment of the invention, the pressure of the portion of condensed residual gas fed into the scrubbing column is, for this purpose, adjusted to the pressure of the scrubbing column.

This provision ensures that the residual gas stream obtained from the head of the scrubbing column is at an elevated pressure, the range of the latter extending suitably up to the crude gas pressure. The resultant gaseous head product from the scrubbing column can thus be passed on to further separation without any appreciable losses.

In case of a combination of $H_2/C_{3+}$ separation, the ethane-enriched gaseous head product of the scrubbing column contributes significantly toward attainment of an adequate Joule-Thomson effect in the subsequently arranged $H_2$ purification stage.

The invention moreover provides that, prior to mixing the residual liquid fraction expanded for production of refrigeration with the residual gas from rectification, a pressure adjustment of either or both streams is performed. The pressure of the resultant mixture stream is adjusted to the pressure of the scrubbing column.

Adjustment of the pressures of the two streams which form the mixture can be performed, on the one hand, by expanding one of them to the pressure of the other, or, on the other hand, elevating the pressure of one of the streams to the pressure of the other.

However, in either case, adjustment of the pressure of the resultant mixture to the pressure of the scrubbing column is subsequently effected. This is normally done by compressing the mixture stream since the pressure level of the scrubbing column usually lies above that of the rectification column.

Generally, the pressure difference between the two streams, prior to pressure adjustment, which form the mixture stream is about 5 to 34 bar, preferably 15 to 30 bar. The pressure difference between the resultant mixture stream and that of the scrubbing column is generally about 1 to 10 bar, preferably 2 to 5 bar.

It is furthermore suggested in accordance with this invention to make the quantitative ratio of the portion of the liquid fraction expanded for the production of refrigeration to the portion of the liquid fraction introduced into the scrubbing column to be about 0.43–2.3:1, preferably 0.7 – 1.5:1.

This proportion ensures, on the one hand, a continued efficient scrubbing action in the scrubbing column and, at the same time, makes available an adequate amount of refrigerating medium.

The process according to the invention is especially suitable for separation of gaseous mixtures wherein the separation procedure involves the combination of various stages for the separation of $H_2$ and/or hydrocarbons, operating under high inlet pressures. Thus, it is possible, by employing the process of the invention to, for example, perform any desired combinations of two separating stages, consisting of separation of $C_{5+}$, $C_{3+}$, $C_{2+}$ and/or $H_2$, in an especially energy-saving and efficient way.

The process is generally suitable for the separation of gaseous mixtures containing lower- and higher-boiling hydrocarbons, especially separation of $C_{2+}$ or $C_{3+}$ hydrocarbons. Thus, the components of the gaseous mixture to be separated can, for example, include $H_2$, $N_2$, CO, $CO_2$, $H_2S$, mercaptans, $CH_4$, $C_2H_6$, $C_2H_4$, $C_2H_2$, $C_3H_8$, $C_3H_6$, $C_3H_4$, and/or $C_{3+}$. The process is particularly suitable for treating gaseous mixtures comprising $H_2$, $CH_4$, and $C_{2+}$ or $C_{3+}$ hydrocarbons.

Two liquid bottoms streams are at the bottom of the scrubbing column. One of which is actually the liquid originating from the internals (trays, etc.) of the scrubbing column is expanded and then delivered to an upper portion of the rectification column and the other of which is the liquid fraction of the feed gas stream routed to the scrubbing column, is heated, expanded, and then delivered to the rectification column at a point below that of the introduction of the previously mentioned liquid bottoms stream from scrubbing. The volumetric ratio of the liquid bottoms stream which is delivered to an upper portion of the rectification column to the other liquid bottoms stream which is delivered to the rectification at a point below thereof is generally about 1:10 to 10:1, preferably 1:3 to 3:1.

The gaseous feedstreams are generally introduced into the process at a pressure of about 10 to 40 bar, preferably 20 to 30 bar, and at a temperature of about 250 to 350K, preferably 280 to 320K. The pressure of residual gaseous streams discharged from the process is generally about 4 to 38 bar, preferably 20 to 35 bar.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire texts of all applications, patents and publications cited above, and of corresponding German priority application No. P 38 14 294.5, are hereby incorporated by reference.

BRIEF DESCRIPTION OF THE DRAWINGS

Various other objects, features and attendant advantages of the present invention will be more fully appreciated as the same becomes better understood when considered in conjunction with the accompanying drawings in which like reference characters designate the same or similar parts throughout the several views, and wherein.

DETAILED DESCRIPTION OF THE DRAWINGS

Figure 1:
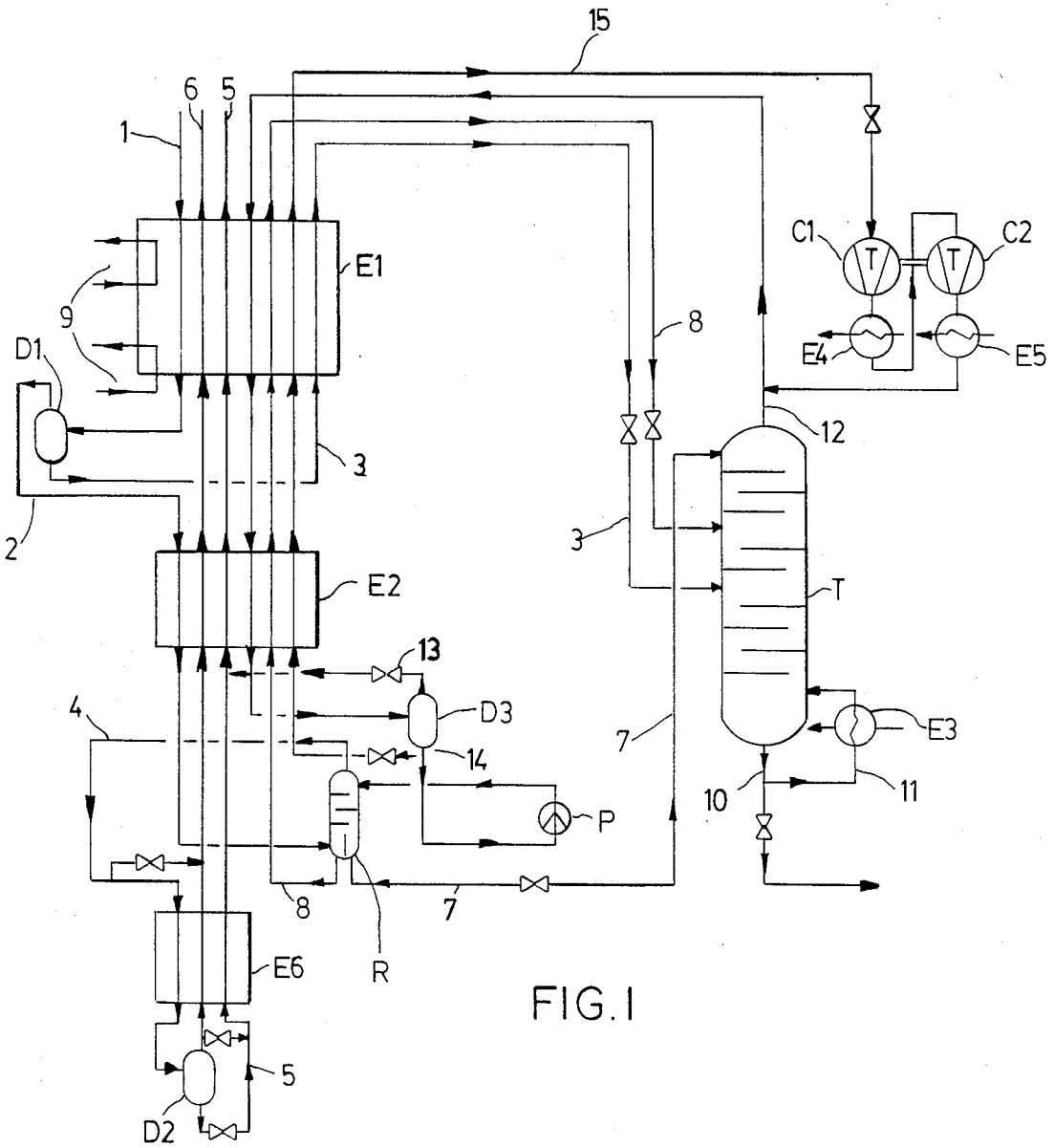
FIG. 1 illustrates an embodiment of the invention wherein separation of partially condensed residual gas from rectification is performed in a separate phase separator.

Figure 1:

A crude gas stream at about 260 bar and about 311 K is introduced to the process via conduit 1, partially condensed in heat exchanger E1 by indirect heat exchange, and separated in separator D1 into a liquid fraction and a gaseous fraction. The liquid fraction is withdrawn via conduit 3 and, after being heated in heat exchanger E1, is expanded into a middle zone of the rectification column T. The gaseous fraction is removed from separator D1 via conduit 2 and, after further cooling in heat exchanger E2, is introduced at a temperature of about 212K and a pressure of about 25.4 bar into a lower zone of scrubbing column R (having 5 theoretical plates) wherein further components are removed from the gaseous fraction by scrubbing.

At the bottom of the scrubbing column R, the thus-obtained bottom liquid fraction is discharged via conduits 7. The liquid fraction in conduit 7 is expanded and delivered directly into an upper zone of rectification column T. The liquid fraction of the lower feed stream to column R which had been kept separate from the reflux stream inside column R, in conduit 8 is first heated in heat exchangers E2 and E1 before being expanded and delivered directly into a middle zone of rectification column T (having 25 theoretical plates).

From the bottom of rectification column T, a liquid product fraction containing essentially higher-boiling components is withdrawn via conduit 10. By way of the tap conduit 11, a portion of the product liquid fraction in conduit 10 is branched off, heated in heat exchanger E3, and returned to the bottom of rectification column T as a reboiler stream. From the head of rectification column T a residual gas stream still containing desirable heavy components is obtained.

By means of conduit 12, this residual gas stream at a temperature of about 288K and a pressure of about 24.0 bar is withdrawn, partially condensed in heat, exchangers E1 and E2, and separated in separator D3 into a residual gaseous fraction and a residual liquid fraction. By way of conduit 14, a portion of the residual liquid fraction, after compression in pump P, is introduced for scrubbing purposes into an upper zone of the scrubbing column R. Prior to compression, a portion of the residual liquid fraction in conduit 14 is branched off by way of tap conduit 15, subjected to expansion for production of refrigeration, heated in heat exchangers E2 and E1 by heat exchange with streams to be cooled from conduits 1 (crude gas) and 12 (residual gas stream from rectification column T) and, after compression in compressors C1 and C2 and reheating in heat exchangers E4 and E5, is readmixed with the residual gas stream from the head of rectification column T.

The residual gas obtained at the head of scrubbing column R, consisting of lower-boiling components, is, after discharge via conduit 4, at least in part subjected to partial condensation in heat exchanger E6. Thereafter, the partially condensed residual gas is separated in separator D2 into gaseous and liquid portions. The gaseous portion is withdrawn via conduit 6 at a pressure of about 24.0 bar. The liquid portion is heated and discharged from the system via conduit 5 together with the residual gaseous fraction from removed separator D3 via conduit 13 at a pressure of about 1.2 bar. The streams in conduits 5 and 6 are product streams containing lower-boiling components. The streams 9 of heat exchanger E1 are auxiliary cycles for production of refrigeration.

Figure 2:

A crude gas stream at about 13.3 bar and about 311 K is conducted via conduit I, after cooling and partial condensation by indirect heat exchange in heat exchanger E1, to separator D1 and therein separated into a liquid fraction and a gaseous fraction. The liquid fraction is withdrawn via conduit 3, expanded, and, after being heated in heat exchanger E1, is conducted into a middle zone of the rectification column T (having about 20 theoretical plates) at a temperature of about 200 K and a pressure of about 6.6 bar. The gaseous fraction discharged from separator D1 is, after further cooling in heat exchanger E2, introduced via conduit 2 into a lower zone of the scrubbing column R (having about 4 theoretical plates) at a temperature of about 155 K and a pressure of about 12.5 bar. Via conduits 7 and 8, the liquid fraction obtained from the bottom of the scrubbing column is withdrawn therefrom. The liquid fraction in conduit 8 is expanded, heated in heat exchanger E2, and introduced into a middle zone of the rectification column T whereas the liquid fraction in conduit 7 is expanded directly into an upper zone of rectification column T. The liquid product fraction obtained in the bottom of rectification column T is removed via conduit 10. A portion of this liquid fraction is returned, after heating in heat exchanger E3, as a reboiler stream into the bottom of the rectification column T. The remaining portion of the liquid product fraction is compressed by pump P and discharged after heating in E1.

The head gaseous product of rectification column T, withdrawn by means of conduit 12 at a temperature of about 183 K and a pressure of about 6.5 bar, is heated in E1, expanded, and then mixed with ther compressed and heated stream of conduit 16. The resultant mixture is further compressed, in conduit 17, by means of compressor C2, and then cooled in heat exchanger E5. After cooling and partial condensation in heat exchangers E1 and E2, the stream of conduit 17 is expanded into a separation zone of the scrubbing column R. The separation zone is located in an upper portion of the scrubbing column R and segregated from the actual scrubbing zone in a lower portion of the scrubbing column R by means of a flue plate. A gaseous product fraction is discharged at the head of the separation zone via conduit 4 and is withdrawn from the process, after being heated in E2 and E1, at a temperature of 308 K and a pressure of about 12.0 bar. The liquid fraction obtained at the flue plate is withdrawn via conduit 16 and is introduced partially as backflow or reflux to the upper region of the scrubbing chamber. The remaining proportion is, after expansion and heating in E2 and E1, compressed by compressor C1, further heated in heat exchanger E4, and mixed with the expanded head gaseous product of the rectification column T. The streams 9 of the heat exchanger E1 are auxiliary cycles for production of refrigeration.

Figure 2:
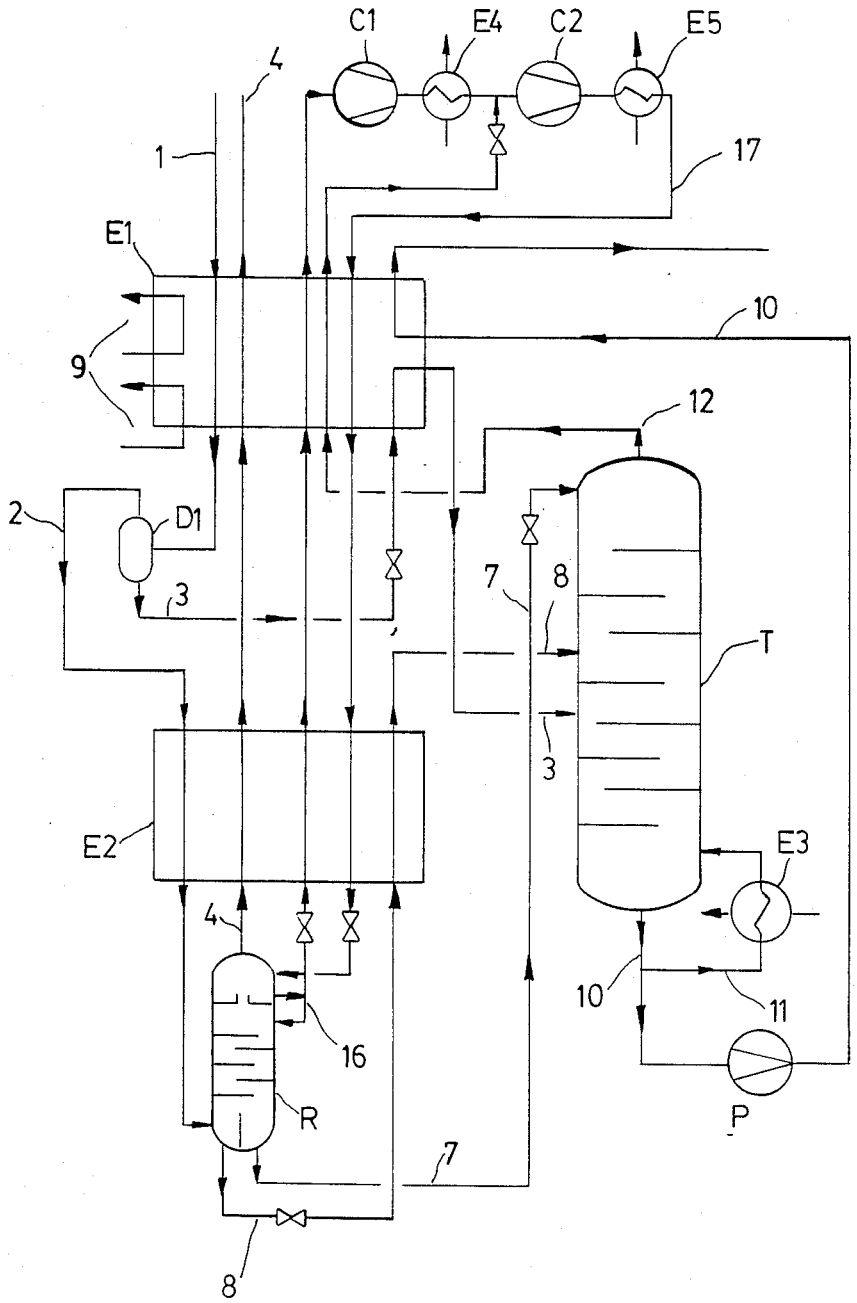
FIG. 2 illustrates an embodiment of the invention wherein the partially condensed residual gas is separated into liquid and gaseous fractions in a separation zone in an upper portion of the scrubbing column.

The process of this invention is illustrated below with the use of a numerical example. The numbers 1, 4, 10, 12 and 17 refer to the streams illustrated in FIG. 2, and listed in the column under the numbers are the mole fractions of the components in the various streams. The crude gas enters as stream 1.

TABLE 1

| Mole Fractions | 1 | 4 | 10 | 12 | 17 |
|---|---|---|---|---|---|
| $H_2$ | 0.35 | 0.5 | — | 0.01 | 0.01 |
| $N_2$ | 0.03 | 0.04 | — | 0.01 | 0.0 |
| CO | 0.0 | 0.0 | — | 0.0 | 0.0 |
| $CH_4$ | 0.31 | 0.44 | — | 0.68 | 0.68 |
| $C_2$ | 0.2 | 0.01 | 0.65 | 0.3 | 0.31 |
| $C_{3+}$ | 0.11 | — | 0.35 | — | — |
| Pressure (bar) | 13.3 | 12.3 | 6.7 | 6.5 | 13.3 |
| Temperature (K) | 311 | 142 | 234 | 183 | 311 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the separation of hydrocarbons from a gaseous feedstream containing light and heavy hydrocarbons, wherein said gaseous feedstream, under superatmospheric pressure, is cooled, partially condensed, and separated into a liquid fraction and a gaseous fraction; said liquid fraction is fractionated by a rectification step into a product stream containing essentially higher-boiling components and a residual gas containing predominantly lower-boiling components;

said gaseous fraction is introduced into a scrubbing column wherein higher-boiling hydrocarbons are scrubbed out of said gaseous fraction by residual gas obtained during said rectification step, after the partial condensation of said residual gas; and a bottom liquid fraction, obtained in the bottom of the scrubbing column, is fed to said rectification step; the improvement which comprises:

separating said residual gas obtained during said rectification step, after its partial condensation and prior to being fed into a scrubbing zone of said scrubbing column, into a residual gaseous fraction and a residual liquid fraction;

expanding at least a portion of said residual liquid fraction for production of refrigeration;

heating said at least a portion of said residual liquid fraction by heat exchange with partially condensing residual gas obtained during said rectification step; and readmixing said at least a portion of said residual liquid fraction with said residual gas obtained during said rectification step, and at least a portion of the remainder of said residual liquid fraction is fed into said scrubbing column.

2. A process according to claim 1, wherein said gaseous feedstream further contains gaseous components which boil at a lower temperature than methane.

3. A process according to claim 1, wherein only a portion of said residual liquid fraction is expanded for production of refrigeration and the remainder of said residual liquid fraction is fed into said scrubbing column.

4. A process according to claim 1, wherein, prior to its introduction into said scrubbing column, the pressure of said residual gas is adjusted to the pressure of said scrubbing column.

5. A process according to claim 4, wherein the quantitative ratio of the amount of said residual liquid fraction which is expanded for production of refrigeration and the amount of said residual liquid fraction which is fed to said scrubbing column is about 0.43–2.3:1.

6. A process according to claim 1, wherein, prior to readmixing the portion of said residual liquid fraction which has been expanded for production of refrigeration with said residual gas obtained from said rectification step, a pressure adjustment is performed so that the pressure of said portion of said liquid fraction and the pressure of said residual gas are substantially the same.

7. A process according to claim 6, wherein, prior to its introduction into said scrubbing column, the pressure of said residual gas is adjusted to the pressure of said scrubbing column.

8. A process according to claim 6, wherein the quantitative ratio of the amount of said residual liquid fraction which is expanded for production of refrigeration and the amount of said residual liquid fraction which is fed to said scrubbing column is about 0.43–2.3:1.

9. A process according to claim 1, wherein the quantitative ratio of the amount of said residual liquid fraction which is expanded for production of refrigeration and the amount of said residual liquid fraction which is fed to said scrubbing column is about 0.43–2.3:1.

10. A process according to claim 1, wherein separation of said residual gas after its partial condensation is conducted in a separate phase separator.

11. A process according to claim 1, wherein separation of said gas after its partial condensation is performed in a separation zone in an upper portion of said scrubbing column.

12. A process according to claim 1, wherein said residual gaseous fraction after its discharge from the separation step is expanded and heated.

13. A process according to claim 1, wherein said residual gaseous fraction, after being discharged from the separation step, is delivered to a $H_2$ purification step.

14. A process according to claim 1, wherein said residual gaseous fraction from the separation step is combined with a gaseous stream from said scrubbing column and the resultant mixture is heated by heat exchange with process streams to be cooled.

15. A process according to claim 1, wherein a gaseous stream discharged from an upper portion of said scrubbing column is at least in part cooled and partially condensed by heat exchange with process streams to be heated, the resultant partially condensed gaseous stream from the scrubbing column is separated into a liquid portion and a gaseous portion, said gaseous portion is heated by heat exchange with process streams to be cooled, and said liquid portion is expanded and heated by heat exchange with process streams to be cooled.

16. A process according to claim 15, wherein said residual gaseous fraction is expanded, combined with said liquid portion, and the resultant mixture is heated by heat exchange with process streams to be cooled.

17. A process according to claim 1, wherein a bottom liquid fraction accumulating in the bottom of said scrubbing column is divided into a first bottom liquid fraction and a second bottom liquid fraction, said first bottom liquid fraction is expanded and delivered directly to an upper portion of said rectification step, and said second bottom liquid fraction is heated by heat exchange with process streams to be cooled, expanded and delivered to said rectification step at a point below the introduction of said first bottom liquid fraction to said rectification step.

18. A process according to claim 1, wherein said at least a portion of said residual liquid fraction, after being heated by heat exchange with condensing residual gas, is expanded, compressed, heated, compressed, and heated prior to its admixture with said residual gas obtained from said rectification step.

19. A process according to claim 1, wherein said residual gas stream, prior to being admixed with said at least a portion of said residual liquid fraction, is heated by heat exchange with process streams to be cooled.

20. A process according to claim 1, wherein said residual gas obtained from said rectification step is heated, expanded, admixed with said at least a portion of said residual liquid fraction, and the resultant mixture is compressed and heated prior to partial condensation of said residual gas.

21. A process according to claim 1, wherein said at least a portion of said residual liquid fraction, after being heated by heat exchange with condensing residual gas, is compressed and then heated prior to admixture with said residual gas.

22. A process according to claim 1, wherein said product stream from said rectification step contains essentially $C_{2+}$ hydrocarbons.

23. A process according to claim 1, wherein said product stream from said rectification step contains essentially $C_{3+}$ hydrocarbons.

* * * * *